United States Patent [19]

Matsui

[11] Patent Number: 5,004,356

[45] Date of Patent: Apr. 2, 1991

[54] FASTENER AND WRAPPING BAG HAVING THE SAME

[75] Inventor: Kazufumi Matsui, Himeji, Japan

[73] Assignee: Idemitsu Petrochemical Co., Ltd., Tokyo, Japan

[21] Appl. No.: 443,000

[22] Filed: Nov. 28, 1989

[30] Foreign Application Priority Data

Nov. 29, 1988 [JP] Japan ..... 63-303391

[51] Int. Cl.[5] ..... B65D 33/24

[52] U.S. Cl. ..... 383/63; 24/587

[58] Field of Search ..... 383/63, 65; 156/66; 24/587

[56] References Cited

U.S. PATENT DOCUMENTS

| | | | |
|---|---|---|---|
| 3,172,443 | 3/1965 | Ausnit | 383/63 |
| 3,827,472 | 8/1974 | Uramoto | 383/63 |
| 3,980,225 | 9/1976 | Kan | 383/63 |
| 4,430,070 | 2/1984 | Ausnit | 493/215 |
| 4,601,694 | 7/1986 | Ausnit | 493/381 |
| 4,673,383 | 6/1987 | Bentsen | 493/381 |
| 4,709,533 | 12/1987 | Ausnit | 51/451 |
| 4,756,629 | 7/1988 | Tilman et al. | 383/63 |
| 4,767,220 | 8/1988 | Kamp | 383/63 |

FOREIGN PATENT DOCUMENTS

0023817A1 11/1981 European Pat. Off. .

*Primary Examiner*—Stephen P. Garbe

*Attorney, Agent, or Firm*—Flynn, Thiel, Boutell & Tanis

[57] ABSTRACT

The present invention relates to a fastener having a pair of elements capable of being engaged to each other and relates to a wrapping bag having the fastener. The fastener is arranged in such a manner that at least its portion to be welded to the bag body is mainly made of ethylene vinyl acetate copolymer resin containing vinyl acetate by 1 to 9% and having melt index of 0.5 to 6.0 g/10 minutes. The wrapping bag having the fastener can be obtained by welding the fastener to a base body, and by sealing the ends of the base film with heat.

14 Claims, 2 Drawing Sheets

FASTENER AND WRAPPING BAG HAVING THE SAME

BACKGROUND OF THE INVENTION

1. Field of the Invention

The present invention relates to a fastener and a wrapping bag having a fastener of this type capable of being used in wrapping food, drugs, sundries, or the like which must have excellent moisture-proof performance or excellent oxygen resistance, and which must be sealed again after being opened.

2. Description of the Related Art

Bags (zipper bags) of a type which can be freely opened and closed by a band-shaped fastener (engagement member) consisting of male and female elements and disposed at the portion to be opened are widely used in a variety of fields such as food, chemical and sundry fields. A variety of methods have been disclosed in order to manufacture bags having fasteners. For example, a method has been disclosed in which a tubular film, having a fastener constituted by a male element and a female element is integrally extrusion-molded by using an extruding die. Another method has been disclosed in which the fastener is extrusion welded on the surface of a film. Furthermore, a method has been disclosed in which a tape having a fastener is previously manufactured, and the tape thus manufactured is secured on the surface of a base film forming the bag by heat-welding or by using an adhesive.

However, the two former of the three above-described methods encounter problems in terms of difficulty in handling and high cost, for example, the type of resin which can be employed is limited, these methods cannot be easily applied to multilayered film base materials, they are difficult to apply to material of various sizes, printing is difficult, and the like. Therefore, a method based on the latter method has been employed recently, this method being arranged such that only the fasteners are manufactured and they are heat-welded on the surfaces of the films forming the bodies of the bags.

In order to manufacture the fasteners, low density polyethylene (LDPE) is usually used, the LDPE however requiring a high temperature of about 140° C. to be melted and welded. Therefore, it takes an excessively long time to raise the temperature of the portion to be welded. As a result, manufacturing speed must be lowered, causing a problem in terms of low manufacturing efficiency. Furthermore, because of the excessively high welding temperature described above, other problems arise, namely the use of this method results in excessively high energy cost, and wrinkles due to the sealing cannot be prevented, causing the quality of the products to deteriorate. In addition, relatively high rigidity involved sometimes causes a problem in terms of handling depending on the type of articles to be wrapped.

Therefore, it is required that the welding temperature be lowered, bag manufacturing speed be raised, and rigidity be lowered for the purpose of improving manufacturing efficiency, saving energy, and improving the appearance of the products.

SUMMARY OF THE INVENTION

An object of the present invention is to provide a fastener and a wrapping bag, which is formed by welding the fastener on its surface, capable of lowering the welding temperature, raising bag manufacturing speed so as to improve manufacturing efficiency and to save energy, and capable of lowering the rigidity so as to be easily handled.

As a result of the study conducted by the inventor of the present invention, the welding temperature can be lowered by using a specific resin in the portion of the fastener to be welded. Therefore, a suitable flexibility can be realized so that the problems experienced with the conventional technology can be overcome, using the present invention.

That is, a fastener according to the present invention comprises at least a portion to be welded to a bag body which is mainly made of ethylene vinyl acetate copolymer resin containing 1 to 9% vinyl acetate by weight and having a melt index of 0.5 to 6.0 g/10 minutes.

A wrapping bag having a fastener according to the present invention comprises a pair of engagable fastener elements arranged such that at least their portions to be welded to the bag body are mainly made of ethylene vinyl acetate copolymer resin containing vinyl acetate by 1 to 9% and having a melt index of 0.5 to 6.0 g/10 minutes, the bag body being then formed into a bag shape.

The resin used in the present invention may be only ethylene vinyl acetate copolymer resin, or a blended body with another resin, for example, low density polyethylene. It is necessary to mainly use ethylene vinyl acetate copolymer resin (EVA).

The resin used in the present invention has its melt index (MI) of 0.5 to 6.0 g/10 minutes in terms of improving a shape remaining characteristic, and contains vinyl acetate by 1 to 9% in terms of improving engaging performance and sealing temperature, preferably its MI is 1.0 to 5.0 g/10 minutes and contains vinyl acetate by 2 to 8%, further preferably, MI is 1.5 to 5.0 g/10 minutes and contains vinyl acetate by 4 to 7%.

That is, if the MI is below 0.5 g/10 minutes or exceeds 6.0 g/10 minutes, its shape remaining characteristic deteriorates. Therefore, the desired shaped fastener cannot be obtained, causing engaging performance to deteriorate. If the content of vinyl acetate is less than 1%, the desired effect of lowering the sealing temperature cannot be obtained. If the same exceeds 9%, its flexibility becomes excessive, causing engaging performance to deteriorate.

DETAILED DESCRIPTION OF THE PREFERRED EMBODIMENTS

Figure 1A:
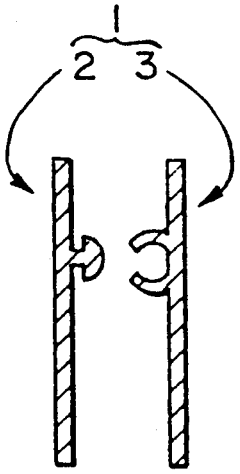
FIGS. 1(A) and 1(B) are cross sectional views each of which illustrate an embodiment of a fastener according to the present invention.
Figure 1B:
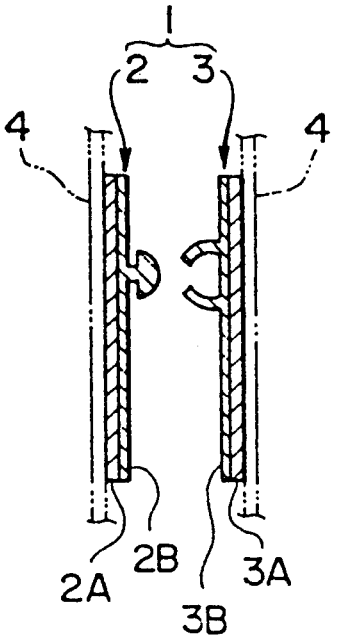

As shown in FIG. 1(A), a fastener 1 according to the present invention may be arranged in such a manner that the overall body of the fastener 1 consisting of a male fastener element 2 and a female fastener element 3 is mainly made of ethylene vinyl acetate copolymer resin containing 1 to 9% vinyl acetate and exhibiting a melt index of 0.5 to 6.0 g/10 minutes. Alternatively, as shown in FIG. 1 (B), the male fastener element 2 and the female fastener element 3 each may consist of two layers, namely, a welding portion layer 2A or 3A to be welded to a bag body 4, and a residual portion layer 2B or having the actual fastener structure formed thereon. Furthermore, only the welding portions 2A and 3A to be welded to the bag body 4 may be mainly made of ethylene vinyl acetate copolymer resin containing 1 to 9% vinyl acetate and exhibiting a melt index of 0.5 to 6.0 g/10 minutes, while the residual portions 2B and 3B may be made of another resin. As another resin, low density polyethylene (LDPE), high density polyethylene (HDPE), and straight chain polyethylene are exemplified. As described above, the strength of the engagement realized by the fastener 1 and the opening facility can be adjusted by forming a multilayered body consisting of the resin mainly made of ethylene vinyl acetate copolymer resin and another resin.

A method of manufacturing the fastener mainly made of ethylene vinyl acetate copolymer resin is not limited particularly. In general, it can be manufactured by using an extrusion die whose shape is approximated to the cross sectional shape of the fastener so as to extrude it by a sole extrusion or co-extrusion method before being cooled down so as to realize the designed shape.

Figure 2:
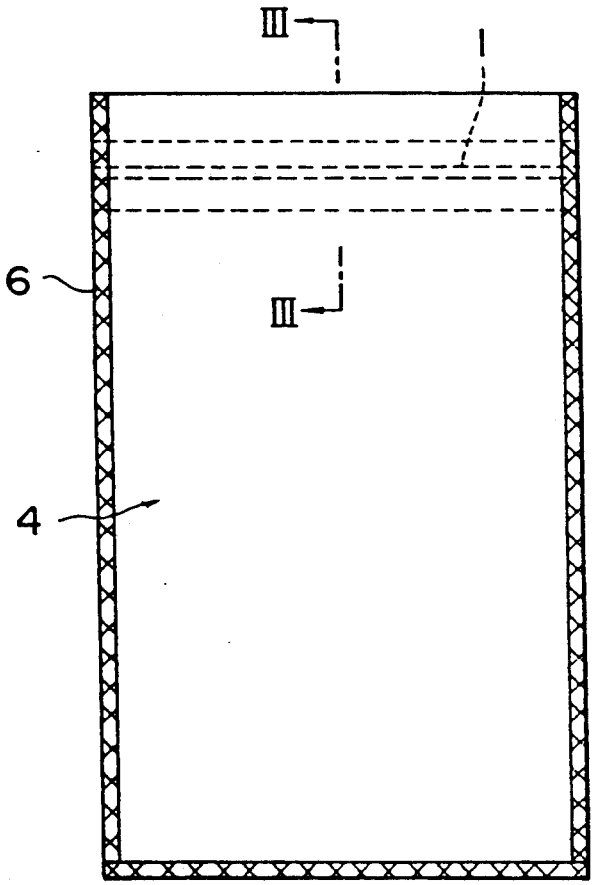
FIG. 2 is a plan view which illustrates an embodiment of a wrapping bag having the fastener according to the present invention.
Figure 3:
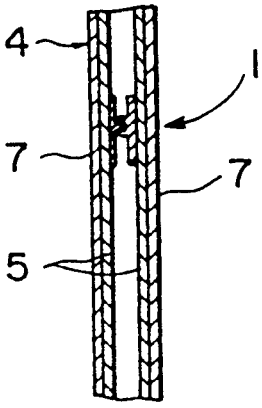
FIG. 3 is an enlarged cross sectional view taken along line III—III in FIG. 2.

The shape of the fastener is not limited to that described above in which the male and female fastener elements are used. Any conventional shape may be employed if it has a function of opening and closing. A wrapping bag having the fastener according to the present invention can be obtained by, for example as shown in FIGS. 2 and 3, sealing an end portion 6 after the fastener 1 according to the present invention has been welded to a base film 5 forming the bag body 4 by employing known means such as high frequency wave or supersonic wave. The base film 5 may comprise a multilayered material in which metal foils 7 such as aluminum foils are stacked.

The base film 5 is not limited in particular. It may be formed by a single layer film, a multilayered film, or a laminated film. The multilayered laminated film may comprise the film formed by combining ethylenevinyl alcohol copolymer having a gas barrier performance, polyvinylidene chloride, polyacrylonitrile, polyamide (nylon), or metal such as aluminum and another film. Furthermore, a multilayered material comprising paper, unwoven fabric or the like may be employed. The multilayered film and the multilayered material may be formed to have three or more layers each of which is made of the material described above in order to satisfactorily wrap the articles.

Specifically, the base film 5 to be welded to the fastener 1 according to the present invention is exemplified by ONY/LDPE, PET/LDPE, PET/Al/LDPE, ONY/LLDPE, PET/LLDPE, PET/Al/LLDPE, ONY/EVA, PET/EVA, PET/Al/EVA, and the like, where symbols ONY represents biaxially-oriented nylon (polyamide), PET represents polyester (polyethylene terephthalate), Al represents aluminum foil, LLDPE represents straight chain low density polyethylene, and the other symbols represent the same element described above.

The wrapping bag having the fastener according to the present invention can be welded at low temperature, and has a strong welding force so that the welding work can be efficiently and stably conducted. In addition, since the fastener has a proper flexibility, it can be handled easily.

EXPERIMENTAL EXAMPLE

The fastener 1 shown in FIG. 1(A) was obtained by extrusion-molding by using ethylene vinyl acetate copolymer resin (EVA) and cooling down the molded body thus formed. In order to determine the most suitable characteristics and the content of ethylene vinyl acetate vinyl copolymer resin as the material for the fastener, 9 types fasteners including EVA sole bodies (non-blended bodies) which had individual melt indexes (MI) and individual contents (weight %) of vinyl acetate, 4 types fasteners including blended body in which mixture ratio between EVA and LDPE was varied, and a fastener made of conventional low density polyethylene (LDPE) serving as reference were manufactured. The blended body consisting of EVA which had MI=2.5 g/10 minutes and included vinyl acetate by 6%, and that consisting LDPE which had MI=1.0 were used.

The obtained tape having the fastener was welded to the base film 5 consisting of biaxially oriented nylon/-low density polyethylene (thickness: 15 mm/120 mm) so as to evaluate the shape consistency, engaging performance, and the sealing temperature (° C.) with respect to the base film 5. The results are shown in Table 1.

In Table 1, the factor "shape remaining characteristic" is a factor for evaluation conducted in such a manner that a state in which the special shape portion of the fastener is retained as designed is shown by using symbol "O", a state in which the designed shape is almost retained is shown by using symbol "Δ", and a state in which the designed shape is lost is shown by using symbol "X".

The factor "engaging performance" is a factor for evaluation conducted in such a manner that a state in which the male and female elements can be fastened easily is shown by using symbol "O", a state in which they cannot be fastened easily is shown by using symbol "Δ", and a state in which they cannot be fastened is shown by using symbol "X".

The factor "sealing temperature" is evaluated in terms of the temperature set for a fastener-equipped bag making machine.

The factor "torsional rigidity" is measured in accordance with ASTN D1043.

TABLE 1

| Sample No. | Material | MI (g/10 minutes) | Content of vinyl acetate (wt %) | Shape remaining characteristic | Engaging Performance | Sealing temperature (°C.) | Torsional rigidity ratio (kgf/cm) |
|---|---|---|---|---|---|---|---|
| 1 | EVA ① | 2.5 | 6 | O | O | 128 | 360 |
| 2 | EVA ② | 5.0 | 6 | O | O | 128 | 350 |
| 3 | EVA ③ | 1.5 | 2 | O | O | 133 | 400 |
| 4 | EVA ④ | 1.5 | 1 | O | O | 135 | 450 |
| 5 | EVA ⑤ | 2.5 | 8 | O | Δ | 125 | 290 |
| 6 | EVA ⑥ | 3.0 | 10 | O | X | 120 | 250 |
| 7 | EVA ⑦ | 0.5 | 6 | Δ | Δ | 130 | 370 |
| 8 | EVA ⑧ | 7.0 | 6 | X | X | 126 | 330 |

TABLE 1-continued

| Sample No. | Material | MI (g/10 minutes) | Content of vinyl acetate (wt %) | Shape remaining characteristic | Engaging Performance | Sealing temperature (°C.) | Torsional rigidity ratio (kgf/cm) |
|---|---|---|---|---|---|---|---|
| 9 | EVA ⑨ | 0.3 | 6 | X | X | 132 | 380 |
| 10 | Mixture ratio EVA/LDPE 70/30 (wt %) | — | — | O | O | 130 | 420 |
| 11 | Mixture ratio EVA/LDPE 60/40 (wt %) | — | — | O | O | 133 | 440 |
| 12 | Mixture ratio EVA/LDPE 50/50 (wt %) | — | — | O | O | 135 | 450 |
| 13 | Mixture ratio EVA/LDPE 40/60 (wt %) | — | — | O | O | 138 | 490 |
| 14 | LDPE | 1.0 | — | O | O | 140 | 550 |

As can be seen from Table 1, the resin according to the present invention must meet the following conditions:

As is shown from Sample Nos. 8 and 9, the MI is required to be 0.5 to 6.0 g/10 minutes in order to meet the required shape remaining characteristic. As is shown from Sample Nos. 4 and 6, the content of vinyl acetate is required to be 1 to 9% in order to meet the required engaging performance and sealing temperature. In particular, the material having MI=1.0 to 5.0 g/10 minutes and content of vinyl acetate 2 to 8% is preferable to be employed in order to meet the required shape remaining characteristic, engaging performance, sealing temperature, and flexibility. It is preferable to employ a material having MI=1.5 to 5.0 g/10 minutes and content of vinyl acetate 4 to 7%.

It is necessary for the mixture rate in the EVA/LDPE mixed material to restrict LDPE below 50 w % in order to meet the required sealing temperature and torsional rigidity, that is, in order to meet the required flexibility. Therefore, EVA must be employed mainly.

The conventional material LDPE is inferior in terms of the sealing temperature and the torsional rigidity.

As described above, the preferable materials are Sample Nos. 1 to 5, 7, and 10 to 12. These materials can be easily welded at low temperature, and exhibits a satisfactory welding force. In addition, they exhibit excellent opening facility of the fastener and the resealing performance. Furthermore, they display an excellent appearance, in particular, wrinkles due to the sealing can be prevented, and proper flexibility was obtained.

According to the present invention, the welding temperature with respect to the base film forming the bag body can be lowered, for example, it can be lowered by 5 to 20° C. with respect to the conventional fastener by mainly using ethylene vinyl acetate copolymer resin. Therefore, bag manufacturing speed can be raised, causing manufacturing efficiency to be improved, and the energy to be consumed can be saved. In addition, sealing can be conducted at low temperature, and the appeared wrinkles can be prevented. Furthermore, because of its significant flexibility with respect to the conventional polyethylene, it can be easily handled.

The wrapping bag having the fastener according to the present invention can be welded at low temperature of a level which has been difficult to be conducted by the conventional polyethylene fastener. Therefore, bag manufacturing speed can be raised, the manufacturing yield can be improved, and energy can be saved. In addition, wrinkles due to the sealing can be prevented, and its appearance quality can be improved. Consequently, its product quality can be improved.

Therefore, the fastener according to the present invention can be preferably used for wrapping food, drugs, adhesive drugs (poultices), and sundries in moisture proof wrapping, deoxidation wrapping, and anti-dry wrapping. Furthermore, the fastener according to the present invention can be preferably used for re-sealing purposes. Consequently, a great advantage can be realized by using the fastener according to the present invention.

What is claimed is:

1. In a fastener including a pair of fastener elements which are engagable with each other, the improvement wherein:

each said fastener element has at least a portion which is mainly made of ethylene vinyl acetate copolymer resin containing 1 to 9% vinyl acetate by weight and having a melt index 0.5 to 6.0 g/10 minutes, and said portions being adapted to be welded to a bag body.

2. A fastener according to claim 1, wherein said fastener is made of only said ethylene vinyl acetate copolymer resin.

3. A fastener according to claim 1, wherein said fastener is made of a blend of said ethylene vinyl acetate copolymer resin and another resin containing low density polyethylene.

4. A fastener according to claim 1, wherein the weight content of said vinyl acetate in said ethylene vinyl acetate copolymer resin is 2 to 8%.

5. A fastener according to claim 1, wherein said melt index of said ethylene vinyl acetate copolymer resin is 1.5 to 5.0 g/10 minutes.

6. A wrapping bag having a bag body, and a fastener comprising a pair of fastener elements which are engagable with each other and which have respective portions thereof welded to said bag body, at least said portions of said fastener elements which are welded to said bag body being mainly made of ethylene vinyl acetate copolymer resin containing 1 to 9% vinyl acetate by weight and having a melt index of 0.5 to 6.0 g/10 minutes, and said bag body being formed into a bag shape.

7. A wrapping bag according to claim 6, wherein said fastener is made of only said ethylene vinyl acetate copolymer resin.

8. A wrapping bag according to claim 6, wherein said fastener is made of a blend of said vinyl acetate copolymer resin and another resin containing low density polyethylene.

9. A wrapping bag according to claim 6, wherein the weight content of said vinyl acetate in said ethylene vinyl acetate copolymer resin is 2 to 8%.

10. A wrapping bag according to claim 6, wherein said melt index of said ethylene vinyl acetate copolymer resin is 1.5 to 5.0 g/10 minutes.

11. A wrapping bag according to claim 6, wherein said fastener includes a male fastener element and a female fastener element, said male fastener element and said female fastener element each being a multilayered structure having said portion to be welded as one layer and a residual portion as another layer.

12. A wrapping bag according to claim 11, wherein said residual portion is made from one of low density polyethylene resin, high density polyethylene resin, and straight chain polyethylene resin.

13. A wrapping bag according to claim 6, wherein said bag body is formed from a single layer base film.

14. A wrapping bag according to claim 6, wherein said bag body is formed from a multilayered base film.

* * * * *

UNITED STATES PATENT AND TRADEMARK OFFICE

CERTIFICATE OF CORRECTION

PATENT NO. : 5 004 356

DATED : April 2, 1991

INVENTOR(S) : Kazufumi MATSUI

It is certified that error appears in the above-identified patent and that said Letters Patent is hereby corrected as shown below:

Column 6, line 63; after "said" insert ---ethylene---.

Signed and Sealed this

Tenth Day of November, 1992

*Attest:*

DOUGLAS B. COMER

*Attesting Officer*

*Acting Commissioner of Patents and Trademarks*